US009818515B2

(12) United States Patent
Yan et al.

(10) Patent No.: US 9,818,515 B2
(45) **Date of Patent: *Nov. 14, 2017**

(54) MODIFIED ND—FE—B PERMANENT MAGNET WITH HIGH CORROSION RESISTANCE

(75) Inventors: Mi Yan, Hangzhou (CN); Xiangzhi Zhou, Hangzhou (CN); Xiongfei Fan, Dongyang (CN); Tianyu Ma, Hangzhou (CN); Wei Luo, Hangzhou (CN)

(73) Assignees: ZHEJIANG UNIVERSITY, Hangzhou (CN); ZHEJIANG INNUOVO MAGNETICS INDUSTRY CO., LTD, Dongyang (CN)

( * ) Notice: Subject to any disclaimer, the term of this patent is extended or adjusted under 35 U.S.C. 154(b) by 971 days.

This patent is subject to a terminal disclaimer.

(21) Appl. No.: 13/132,266

(22) PCT Filed: Dec. 1, 2008

(86) PCT No.: PCT/CN2008/073271

§ 371 (c)(1),
(2), (4) Date: Jun. 1, 2011

(87) PCT Pub. No.: WO2010/063143

PCT Pub. Date: Jun. 10, 2010

(65) Prior Publication Data

US 2011/0234350 A1 Sep. 29, 2011

(51) Int. Cl.

| | |
|---|---|
| ***H01F 7/02*** | (2006.01) |
| ***H01F 1/057*** | (2006.01) |
| ***H01F 41/02*** | (2006.01) |

(52) U.S. Cl.
CPC ..... *H01F 1/0577* (2013.01); *H01F 41/0266* (2013.01)

(58) Field of Classification Search
CPC .. H01F 1/0577; H01F 1/0571; H01F 41/0293; H01F 1/0536; H01F 1/057;
(Continued)

(56) References Cited

U.S. PATENT DOCUMENTS 5,055,129 A * 10/1991 Ghandehari ..... H01F 1/0577 148/302
5,472,525 A * 12/1995 Tokunaga et al. ..... 148/302
(Continued)

FOREIGN PATENT DOCUMENTS

CN 101026034 8/2007
CN 101055779 A * 10/2007
(Continued)

OTHER PUBLICATIONS

Machine translation of CN101055779A, Oct. 2007.*
(Continued)

*Primary Examiner* — Xiaowei Su
(74) *Attorney, Agent, or Firm* — Hamre, Schumann, Muller & Larson, P.C.

(57) ABSTRACT

A type of sintered Nd—Fe—B permanent magnet with high corrosion resistance is produced by dual alloy method. The method comprises the following steps: preparing the powders of master phase alloy and intergranular phase alloy respectively, mixing the powders, compacting the powders in magnetic field, sintering the compacted body at 1050~1125° C., and annealing at 920-1020° C. and 500-650° C. successively.

6 Claims, 5 Drawing Sheets

(58) Field of Classification Search
CPC ..... H01F 10/126; H01F 1/06; C22C 38/005; C22C 2202/02; C22C 38/06; C22F 1/16
USPC ..... 148/301
See application file for complete search history.

(56) References Cited

U.S. PATENT DOCUMENTS

| | | | | |
|---|---|---|---|---|
| 5,595,608 | A | 1/1997 | Takebuchi et al. | |
| 2008/0223489 | A1 * | 9/2008 | Nagata et al. | 148/101 |

FOREIGN PATENT DOCUMENTS

| | | | | |
|---|---|---|---|---|
| CN | 101266855 | | 9/2008 | |
| CN | 101320609 | | 12/2008 | |
| JP | EP 0249973 | A1 * | 12/1987 | B22F 1/0003 |
| JP | 5217721 | | 8/1993 | |
| JP | 2003-293008 | | 10/2003 | |

OTHER PUBLICATIONS

Machine translation of CN 101266855A. Sep. 2008.*
Predel (Al—Cu phase diagram, 1991).*
International Search report of PCT/CN2008/073271, dated Sep. 3, 2009 (2 pages total).

* cited by examiner

MODIFIED ND—FE—B PERMANENT MAGNET WITH HIGH CORROSION RESISTANCE

FIELD OF THE INVENTION

The present invention relates to modified Nd—Fe—B permanent magnet with high corrosion resistance.

BACKGROUND OF THE INVENTION

Nd—Fe—B magnets have been recently developed as the leading RE permanent magnets with the highest room temperature magnetic properties beneficial for the wide use. The experimental value of the energy product of sintered Nd—Fe—B reached 59.5 MGOe about 93% of the theoretic value in 2006, which was attained through the conventional single-alloy powder metallurgy method. Total weight of the 2006 production of Nd—Fe—B sintered magnets probably reached 50000 metric tones.

But the Nd—Fe—B rare earth permanent magnets are susceptible to oxidation. For conventional sintered Nd—Fe—B magnet, its poor corrosion resistance in various environments is thought to be due to its complex microstructure. In detail, apart from the coarse and uneven $Nd_2Fe_{14}B$ main phase grains, the chemically active netlike Nd-rich grain boundary phase plays an important role in the corrosion process, during which it serves as an effective pathways of intergranular corrosion propagation. As shown in the Table.1, the high chemical activity and the network structure of the Nd-rich phase are mainly responsible for the poor corrosion resistance of these alloys.

TABLE 1

The composition and electrostatic potential of the main phases of Nd—Fe—B magnet

| Phase | Feature | Electrostatic potential V(Ag/AgCl) |
|---|---|---|
| matrix phase | Polygonal, different sizes | −0.515 |
| B-rich phase | Particle precipitation | ≈−0.46 |
| Nd-rich phase | Distribute along the grain boundaries | ≈−0.65 |

The high content of neodymium as one of the most reactive elements may contribute to the high surface disintegration. Such an intergranular mode of corrosion results in irreversible loss in coercivity, contamination, and even total disintegration. The schematic illustration of the electrochemical corrosion of the sintered Nd—Fe—B magnet is shown in FIG. 1. Numerous researches have been carried out to improve their corrosion resistance, either by adding alloying elements to provide better inherent corrosion resistance, or by applying protective coatings on finished magnets.

Many investigations have studied the effect of alloying additions on the magnetic properties and corrosion behavior of NdFeB magnets. The additions can be divided into two groups: (1) Partial substitution of Nd by rare-earth (RE) metals, e.g. Dy, Pr and Tb. (2) Partial substitution of Fe by transition metals and main group elements, e.g. Al, Co, Cr, Cu, Mo, Nb, Ga, Ti, Zr and W. Dy, Pr and Tb additions exert no beneficial effect on the corrosion behavior, whereas, Al, Co, Cu and Ga additions are found to improve the corrosion resistance of NdFeB magnets in many corrosive environments. The improvement in the corrosion resistance is attributed to the change in the microstructure and the segregation of these kinds of additions into intergranular phase regions. It is believed that this microstructure restricted pathways for corrosion propagation through the magnet and effectively suppressed intergranular corrosion process along the intergranular phase. Nevertheless, the addition of alloying elements usually produces an improvement of corrosion resistance at a cost of impairing other properties. The reason is that one or several of the intrinsic magnetic properties of the matrix phase are impaired as these elements are dissolved in the matrix phase.

Furthermore, surface treatment technologies such as nickel electroplating, zinc electroplating, hot dip zinc, nickel electroless plating, electrophoresis, chromate-passivated aluminum coating, organic coating are currently used in corrosion-protecting for NdFeB magnet. Each technology mentioned above has its own shortcomings in applying to NdFeB, such as environmentally unfriendly and higher cost. Therefore, the best way for protecting the magnets from the attacks by climatic and corrosive environments is to improve the intrinsic corrosion resistance.

H. R. Madaah Hosseini et al. produced anisotropic $(Nd, MM)_2(Fe, Co, Ni)_{14}B$-type sintered magnets (MM: denotes a Misch-metal) by the binary powder blending technique (BPBT). The composition of the master alloy was close to the stoichiometric $Nd_2Fe_{14}B$ compound, while the sintering aid (SA) had a composition of $MM_{38.1}Co_{46.4}Ni_{15.4}$. The composition of the MM was 50 wt % Ce-27 wt % La-16 wt % Nd-7 wt % Pr. The magnets were made by blending different ratios of the master alloy and the sintering aid. The corrosion behavior of these magnets was compared with that of the $Nd_{17}Fe_{75}B_8$ base alloy by potentiodynamic polarization measurements in $H_2SO_4$ solution. Compared with the conventional sintered magnet, the magnets possess higher corrosion resistance, which led to less reduction of magnetic properties of the BPBT magnet than that of the conventional sintered magnet. But the amount of Nd-rich grain boundary phases and the electrochemical potential difference between ferromagnetic and intergranular phases reduced little attributed to the high RE-content.

Based on the argumentation, it is necessary to find an alloy (or a method) for improving not only the intrinsic corrosion resistance for coating-free application but also the magnetic performances ($B_r$ and $(BH)_{max}$).

SUMMARY OF THE INVENTION

The present invention relates to a sintered Nd—Fe—B permanent magnet with high corrosion resistance, especially a sintered Nd—Fe—B permanent magnet with high corrosion resistance which is produced by a technique based on an improved two-alloy method wherein composition of intergranular-phase alloy thereof is redesigned.

An object of the present invention is, therefore, to provide a type of sintered Nd—Fe—B permanent magnet with high performances free from the above-mentioned problems.

More particularly, an object of the present invention is to provide a type of sintered Nd—Fe—B permanent magnet with improved intrinsic corrosion resistance for coating-free application in most conditions and high magnetic performances (such as $B_r$ and $(BH)_{max}$).

Another object of the present invention is to provide a modified two-alloy method of manufacturing a Nd—Fe—B permanent magnet with improved intrinsic corrosion resistance as described in the opening paragraph, which is characterized in that the compositions of the intergranular-phase alloy is redesigned and different from any compositions reported before. The electrostatic potential of intergranular-phase alloy is equal to or slightly higher than that of the master-phase alloy. But the melting point of the intergranular-phase alloy is much lower than that of the master-phase alloy.

In the invention, the powders of master-phase alloy and powders of redesigned intergranular-phase alloy are well mingled to form a mixture. Therefore, the mixture is obtained 90~99 wt % of master-phase alloy powders with an average particle size of 3~8 μm and 1~10 wt % of intergranular-phase alloy with an average particle size of 1~4 μm. The average particle size of the powders of intergranular-phase alloy in the mixture is smaller than that of master-phase alloy.

DETAILED DESCRIPTION OF THE INVENTION

Figure 1:
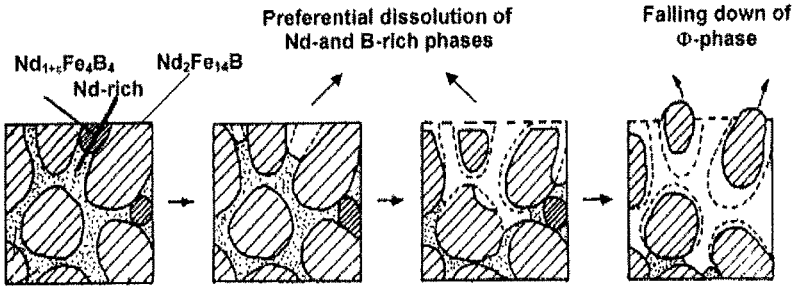
FIG. 1 is a view schematically showing degradation process of sintered Nd—Fe—B magnet by corroded.

The composition of the intergranular-phase alloys is, by atomic percent, 0~5% R, 20~40% N and the balance M, where R is at least one element of Nd, Dy, Tb, Pr, N is at least one element of Co, Ni, Cu, Nb, Mn, Ti and the M is at least one element of Mg, Al, Zn, Sn. The composition of master-phase alloy is, by atomic percent, 12~16% Nd, 5.4~6.6% B, 0.01~6% M and the balance Fe, where M is at least one element of Pr, Dy, Tb, Nb, Co, Ga, Zr, Al, Cu, Si.

The main processing methods include alloy melting, strip casting, ball milling, hydrogen decrepitation, jet milling. The mixture is subsequently aligned in a magnetic field, then compressed under increased pressure and finally sintered.

The density of magnet mensurated by Archimedes law. The microstructures of sintered magnets are investigated using a scanning electron microscope (SEM) equipped with energy dispersive X-ray detector (EDX). Corrosion tests of the magnets are conducted in COR-CELL High Pressure Kettle with size of Φ1×0.5 cm at 5~10 psig, temperature 110~115° C. for 100 h.

The results shows that the mass loss is 28~100 mg/cm$^2$, this is a rather small data, which shows that the resistance of magnet was enhanced. There is a slight increase in density with the increase of additive intergranular-phase alloy at small amount. The micrographs show that the fine and uniform $Nd_2Fe_{14}B$ main phase grains in these magnets, whose average size are approximately 7 μm much smaller than that of the conventional sintered magnet. This kind of microstructures could contribute to the improvement of the corrosion resistance of the magnet as many previous works had been reported. Also, the morphologies of the intergranular phase in the magnets are refined, which result from a better wetting behavior and separation of the hard magnetic grains by the intergranular phase. And the enhanced wetting behavior is due to the melting of intergranular-phase alloys during the sintering. Furthermore, these additions also could improve the electrochemical potential of the intergranular phase and reduce the electrochemical potential differences between ferromagnetic and intergranular phases.

The present invention will be explained in further detail by the following drawings and exemplary embodiments.

EXAMPLES

Example 1

1) The master-phase alloy and redesigned intergranular-phase alloy were prepared respectively. Strip flakes of master-phase alloy were prepared by the strip casting technique. The melted master-phase alloy was ejected onto a spinning copper wheel with a speed of 1.2 m/s, the composition was, by atomic percent, $Nd_{16.2}Fe_{77.15}B_{5.82}$ $(Co_{0.31}Al_{0.24}SiO_{0.28})$. The melted intergranular-phase alloy was ejected onto a spinning copperwheel with a speed of 18 m/s, the composition was, by atomic percent, $Al_{70}Cu_{30}$.

2) The master-phase and redesigned intergranular-phase powders were prepared respectively. The powders were prepared by using jaw-crusher for coarse crushing and medium-crusher for medium crushing. Subsequently, the master-phase alloy was made into powders with average particle diameter 3 μm by jet milling under the protection of the nitrogen and the intergranular-phase with average particle diameter 1 μm by mechanical milling in petroleum ether condition.

3) The mixture powders were prepared by mixing the master-phase alloy powers with 0~10 wt % redesigned intergranular-phase alloy powders and 2 wt % gasoline in blender mixer.

4) The mixture powders were compacted and aligned in a magnetic field of 1.2 T. The green compacts were pressed in a completely sealed glove box to insulate magnetic powders from air.

5) The green compacts were sintered in a high vacuum sintering furnace of $10^{-4}$ pa at temperature 1050° C. for 3 h and then annealed at temperature 920° C. for 3 h then 510° C. for 4 h. Then rapidly cooled it to room temperature at a cooling rate of 200° C./min. Finally, the sintered magnets were obtained.

Figure 2:
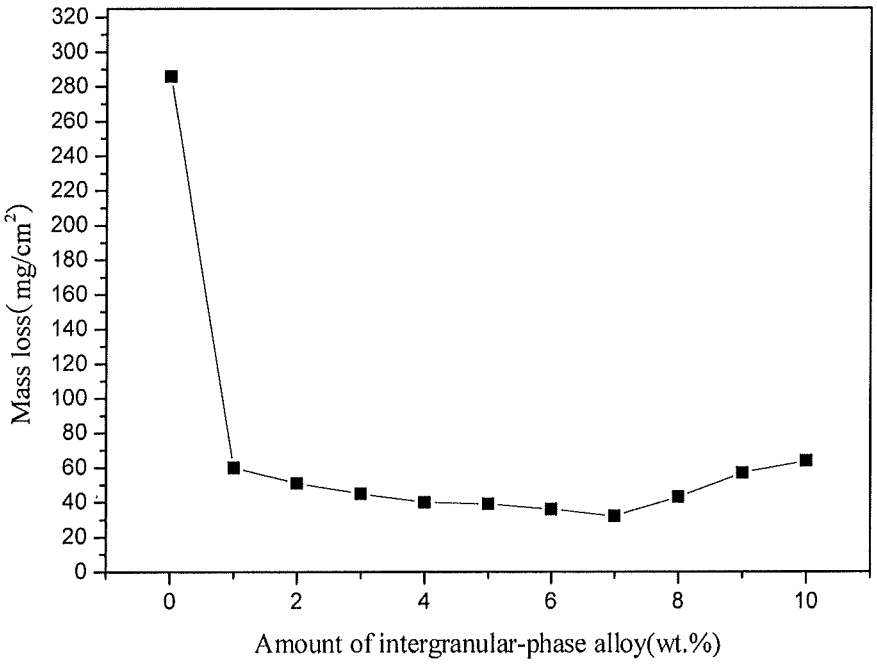
FIG. 2 is a graph showing the mass loss of magnets as function of intergranular-phase alloy additives. The composition of the intergranular-phase is, by atomic percent, $Al_{70}Cu_{30}$. In contrast to the magnet without intergranular-phase alloy additives, magnet with additives shows decreased mass loss in evidence. The mass loss reduces with the increase of additives at the amount of 1~7 wt %.

Corrosion tests of the magnets were conducted in CORCELL High Pressure Kettle with size of Φ1×0.5 cm at 5~10 psig, 110~115° C. for 100 h. The mass loss of magnets as function of intergranular-phase alloy additives was shown in the FIG. 2.

Example 2

1) The master-phase and redesigned intergranular-phase alloys were prepared respectively. Strip flakes were prepared by the strip casting technique. The melted master-phase alloy was ejected onto a spinning copper wheel with a speed of 2.0 m/s, the composition was, by atomic percent, $Nd_{13.12}Fe_{80.69}B_{5.73}(Pr_{0.22}Al_{0.24})$. The melted intergranular-phase alloy was ejected onto a spinning copper wheel with a speed of 18 m/s, the composition was, by atomic percent, $Nd_2Cu_{28}Al_{60}Sn_{10}$.

2) The master-phase and redesigned intergranular-phase powders were prepared respectively. The master-phases were made into powders with average particle diameter 5 μm by HDDR process during which the alloy was hydrogenised to saturation at room temperature and then dehydrogenated into powders at 540° C. for 8 h. Subsequently, the intergranular-phases made into powders with average particle diameter 3 μm by mechanical milling in petroleum ether condition.

3) The mixture powers were prepared by mixing the master-phase alloy powders with 0~10 wt % intergranular-phase alloy powers and 3 wt % gasoline in blender mixer.

4) The mixture powders were compacted and aligned in a magnetic field of 1.4 T. The green compacts were pressed in a completely sealed glove box to insulate magnetic powers from air.

5) The green compacts were sintered in a high vacuum sintering furnace of $10^{-4}$ pa at temperature 1065° C. for 3 h and then annealed at temperature 960° C. for 2 h then 530° C. for 2.5 h. Then rapidly cool it to room temperature at a cooling rate of 300° C./min. Finally, the finished magnets were obtained.

Figure 3:
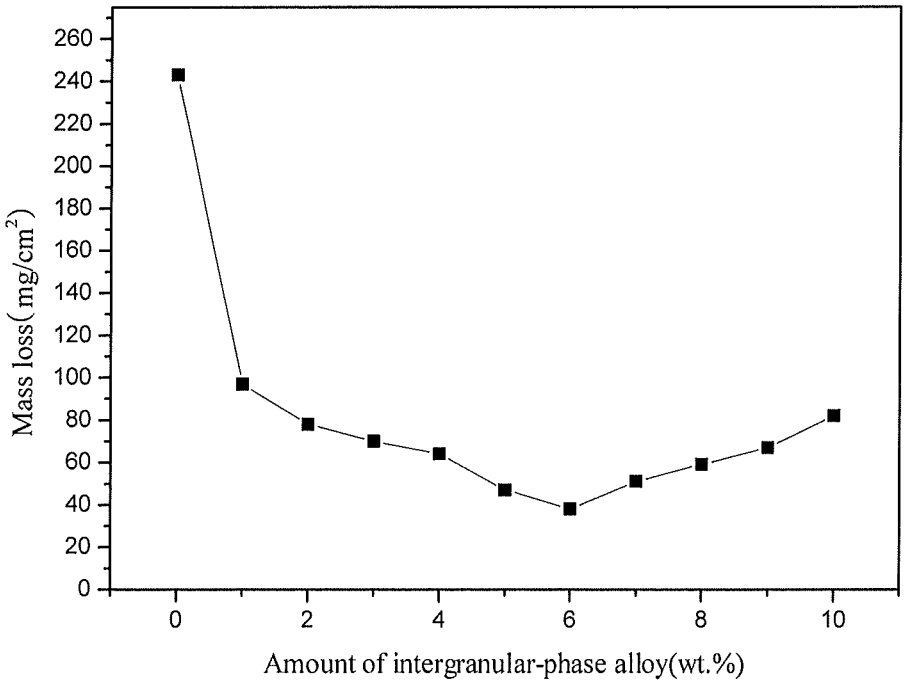
FIG. 3 is a graph showing the mass loss of magnets as function of intergranular-phase alloy additives. The composition of the intergranular-phase is, by atomic percent, $Nd_2Cu_{28}Al_{60}Sn_{10}$. In contrast to the magnet without intergranular-phase alloy additives, magnet with additives shows decreased mass loss in evidence. The mass loss reduces with the increase of additives at the amount of 1~6 wt %.

Corrosion tests of the magnets were conducted in CORCELL High Pressure Kettle with size of Φ1×0.5 cm at 5~10 psig, 110~115° C. for 100 h. The mass loss of magnets as function of intergranular-phase alloy additives was shown in the FIG. 3.

Example 3

1) The master-phase and redesigned intergranular-phase alloys were prepared respectively. Strip flakes were prepared by the strip casting technique. The melted master-phase alloy was ejected onto a spinning copper wheel with a speed of 2.2 m/s, the composition was, by atomic percent, $Nd_{12.55}Fe_{80.55}B_{5.9}Nb_{0.6}Zr_{0.4}$. The melted intergranular-phase alloy was ejected onto a spinning copper wheel with a speed of 18 m/s, the composition was, by atomic percent, $Nd_3Dy_2Cu_{30}Al_{50}Zn_{15}$.

2) The master-phase and redesigned intergranular-phase powders were prepared respectively. The master-phases were made into powders with average particle diameter 4 μm by HDDR process during which the alloy was hydrogenised to saturation at room temperature and then dehydrogenated into powders at 520° C. for 8 h. Subsequently, the intergranular-phases made into powders with average particle diameter 2 μm by mechanical milling in petroleum ether condition.

3) The mixture powers were prepared by mixing the master-phase alloy powers with 0~10 wt % intergranular-phase alloy powers and 2 wt % gasoline in blender mixer.

4) The mixture powers were compacted and aligned in a magnetic field of 1.6 T. The green compacts were pressed in a completely sealed glove box to insulate magnetic powers from air.

5) The green compacts were sintered in a high vacuum sintering furnace of $10^{-4}$ pa at temperature 1085° C. for 4.5 h and then annealed at temperature 1000° C. for 2 h then 560° C. for 3 h. Then rapidly cool it to room temperature at a cooling rate of 400° C./min. Finally, the finished magnets were obtained.

Figure 4:
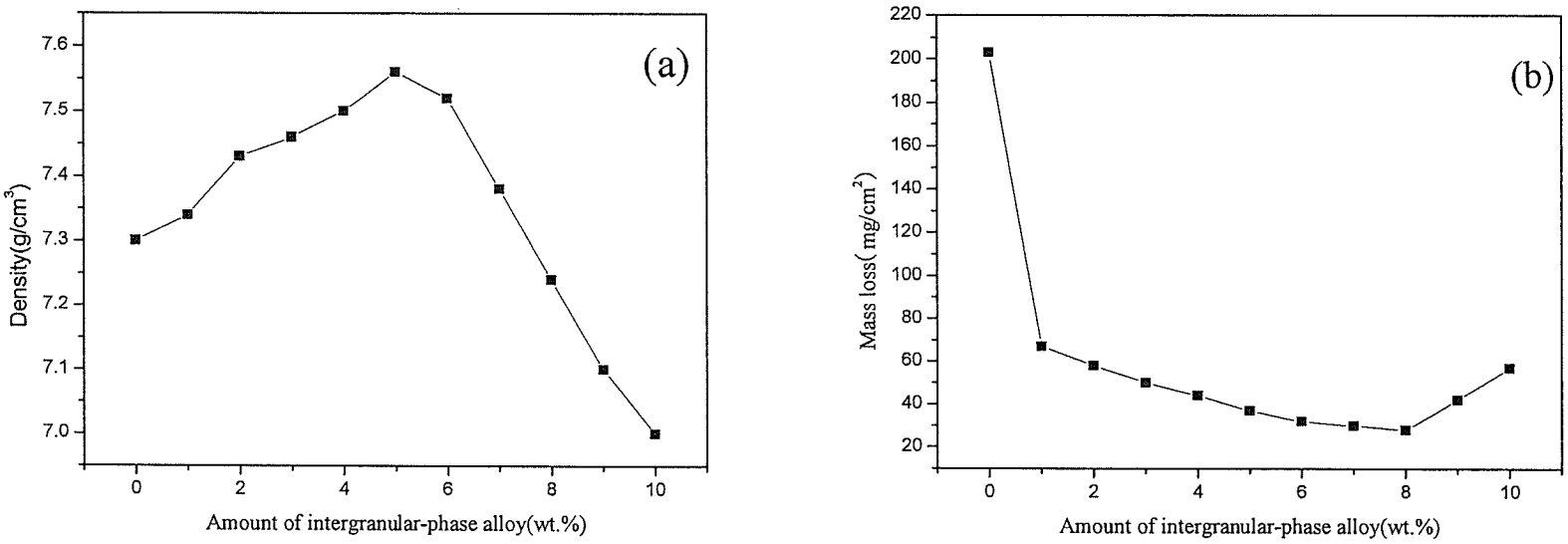
FIG. 4 is a graph showing the density and mass loss of magnets as function of intergranular-phase alloy additives. The composition of the intergranular-phase is, by atomic percent, $Nd_3Dy_2Cu_{30}Al_{50}Zn_{15}$. There is a slight increase in density at small amount of 1~5 wt % additions. In contrast to the magnet without intergranular-phase alloy additives, magnet with additives show decreased mass loss in evidence. The mass loss reduces with the increase of additives at the amount of 1~8 wt %.

Corrosion tests of the magnets were conducted in CORCELL High Pressure Kettle with size of Φ1×0.5 cm at 5~10 psig, temperature 110~115° C. for 100 h. Density was measured by Archimedes' method. The density (a) mass loss (b) of magnets as function of intergranular-phase alloy additives was shown in the FIG. 4.

Example 4

1) The master-phase and redesigned intergranular-phase alloys were prepared respectively. Strip flakes were prepared by the strip casting technique. The melted master-phase alloy was ejected onto a spinning copper wheel with a speed of 2.5 m/s, the composition was, by atomic percent, $Nd_{12.48}Fe_{80.42}B_{5.7}Tb_{0.8}Dy_{0.4}Cu_{0.2}$. The melted intergranular-phase alloy was ejected onto a spinning copper wheel with a speed of 18 m/s, the composition was, by atomic percent, $Tb_2Nb_4Ti_{24}Ni_{16}Mg_{40}Ga_{14}$.

2) The master-phase and redesigned intergranular-phase powders were prepared respectively. The powers were prepared by using jaw-crusher as coarse crushing and followed medium crushing by using medium-crusher. Subsequently, the master-phase alloy was made into powers with average particle diameter 6 μm by jet milling under the protection of the nitrogen and the intergranular-phase with average particle diameter 4 μm by mechanical milling in petroleum ether condition.

3) The mixture powders were prepared by mixing the master-phase alloy powers with 0~10 wt % intergranular-phase alloy powers and 3.4 wt % gasoline in blender mixer.

4) The mixture powders were compacted and aligned in a magnetic field of 1.8 T. The green compacts were pressed in a completely sealed glove box to insulate magnetic powers from air.

5) The green compacts were sintered in a high vacuum sintering furnace of $10^{-4}$ pa at temperature 1080° C. for 3 h and then annealed at temperature 890° C. for 4 h then 580°

C. for 3 h. Then rapidly cool it to room temperature at a cooling rate of 100° C./min. Finally, the finished magnets were obtained.

Figure 5:
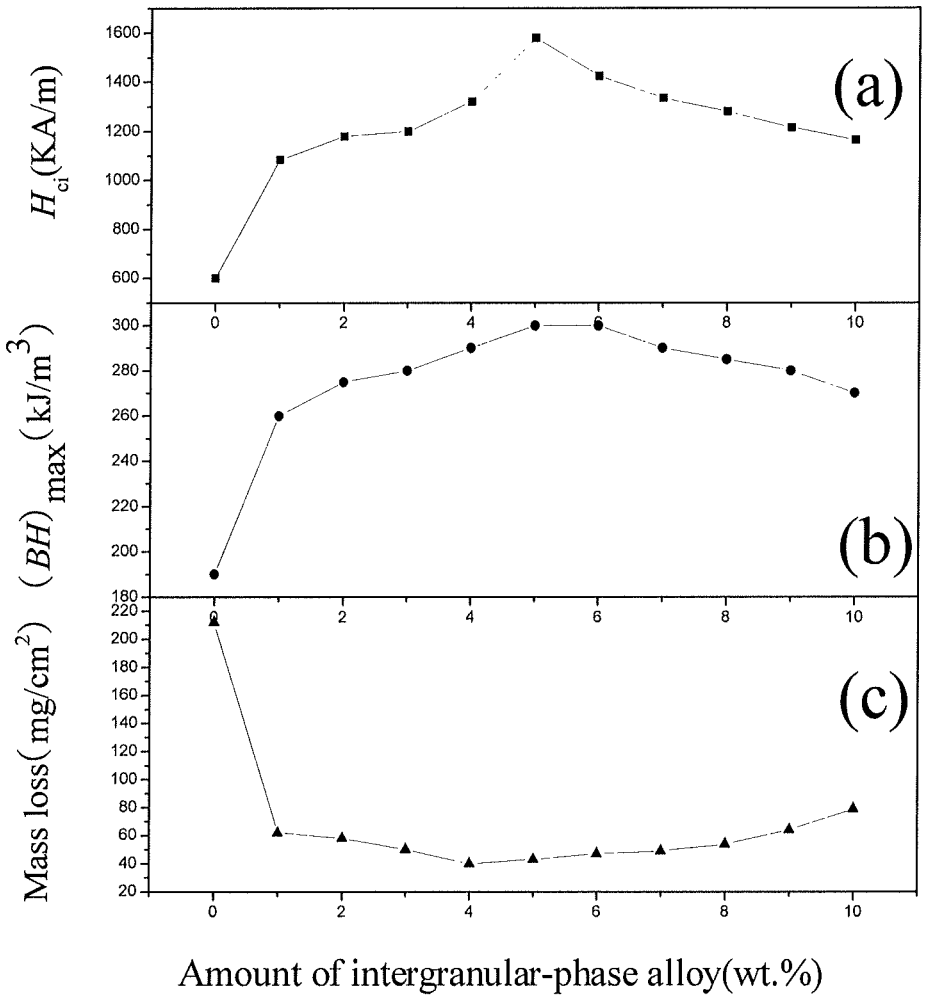
FIG. 5 is a graph showing coercivity $H_{ci}$(a), energy product $(BH)_{max}$(b), and mass loss (c) of magnets as function of intergranular-phase alloy additives. The composition of the intergranular-phase is, by atomic percent, $Tb_2Nb_4Ti_{24}Ni_{16}Mg_{40}Ga_{14}$. In contrast to the magnet without intergranular-phase alloy additives, magnet with additives show decreased mass loss in evidence and increased $H_{ci}$ and $(BH)_{max}$. The mass loss reduces with the increase of additives at the amount of 1~4 wt %.

Corrosion tests of the magnets were conducted in CORCELL High Pressure Kettle with size of Φ1×0.5 cm at 5~10 psig, 110~115° C. for 100 h. Magnetic properties were measured by AMT-4 measurement. The results as shown in the FIG. 5

Example 5

1) The master-phase and redesigned intergranular-phase alloys were prepared respectively. Strip flakes were prepared by the strip casting technique. The melted master-phase alloy was ejected onto a spinning copper wheel with a speed of 2.0 m/s, the composition was, by atomic percent, $Nd_{12.48}Fe_{80.42}B_{5.7}Ga_{0.8}Al_{0.4}Tb_{0.2}$. The melted intergranular-phase alloy was ejected onto a spinning copper wheel with a speed of 18 m/s, the composition was, by atomic percent, $Pr_2Co_6Cu_{28}Al_{50}In_{14}$.

2) The master-phase and redesigned intergranular-phase powders were prepared respectively. The powers of master with average particle diameter 7 μm were prepared by HDDR process during which the alloy was absorbed hydrogen to saturation at room temperature and then dehydrogenated into powers at 500° C. for 8 h. Subsequently, the powders of master-phase alloy with average particle diameter 4 μm were made by mechanical milling in petroleum ether condition.

3) The mixture powers were prepared by mixing the master-phase alloy powers with 0~10 wt % intergranular-phase alloy powers and 3 wt % gasoline in blender mixer.

4) The mixture powers were compacted and aligned in a magnetic field of 2.0 T. The green compacts were pressed in a completely sealed glove box to insulate magnetic powers from air.

5) The green compacts were sintered in a high vacuum sintering furnace of $10^{-4}$ pa at temperature 1100° C. for 3 h and then annealed at temperature 960° C. for 3 h then 600° C. for 3 h. Then rapidly cool it to room temperature at a cooling rate of 300° C./min. Finally, the finished magnets were obtained.

Figure 6:
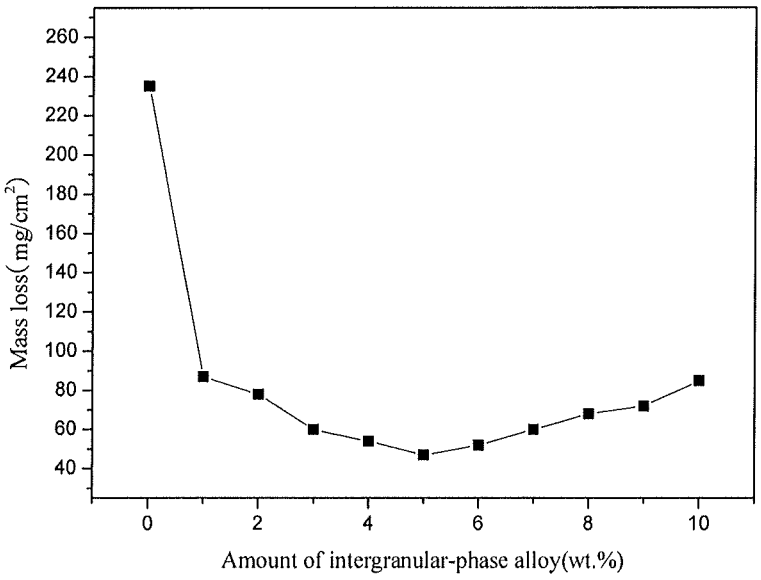
FIG. 6 is a graph showing the mass loss of magnets as function of intergranular-phase alloy additives. The composition of the intergranular-phase is, by atomic percent, $Pr_2Co_6Cu_{28}Al_{50}In_{14}$. In contrast to the magnet without intergranular-phase alloy additives, magnet with additives shows decreased mass loss in evidence. The mass loss reduces with the increase of additives at the amount of 1~5 wt %.

Corrosion tests of the magnets were conducted in CORCELL High Pressure Kettle with size of Φ1×0.5 cm at 5~10 psig, 110~115° C. for 100 h. The mass loss of magnets as function of intergranular-phase alloy additives as shown in the FIG. 6.

Example 6

1) The master-phase and redesigned intergranular-phase alloys were prepared respectively. Strip flakes were prepared by the strip casting technique. The melted master-phase alloy was ejected onto a spinning copper wheel with a speed of 2.0 m/s, the composition was, by atomic percent, $Nd_{13.12}Fe_{80.69}B_{5.73}(Dy_{0.22}Al_{0.24})$. The melted intergranular-phase alloy was ejected onto a spinning copper wheel with a speed of 18 m/s, the composition was, by atomic percent, $Cu_{24}Mn_{10}Al_{60}Bi_6$.

2) The master-phase and redesigned intergranular-phase powders were prepared respectively. The powers of master with average particle diameter 8 μm were prepared by HDDR process during which the alloy was absorbed hydrogen to saturation at room temperature and then dehydrogenated into powers at 500° C. for 8 h. Subsequently, the powders of master-phase alloy with average particle diameter 2 μm were made by mechanical milling in petroleum ether condition.

3) The mixture powers were prepared by mixing the master-phase alloy powers with 0~10 wt % modified intergranular-phase alloy powers and 4.2 wt % gasoline in blender mixer.

4) The mixture powers were compacted and aligned in a magnetic field of 2.0 T. The green compacts were pressed in a completely sealed glove box to insulate magnetic powers from air.

5) The green compacts were sintered in a high vacuum sintering furnace of $10^{-4}$ pa at temperature 1120° C. for 3 h and then annealed at temperature 900° C. for 4 h then 630° C. for 3 h. Then rapidly cool it to room temperature at a cooling rate of 200° C./min. Finally, the finished magnets were obtained.

Figure 7:
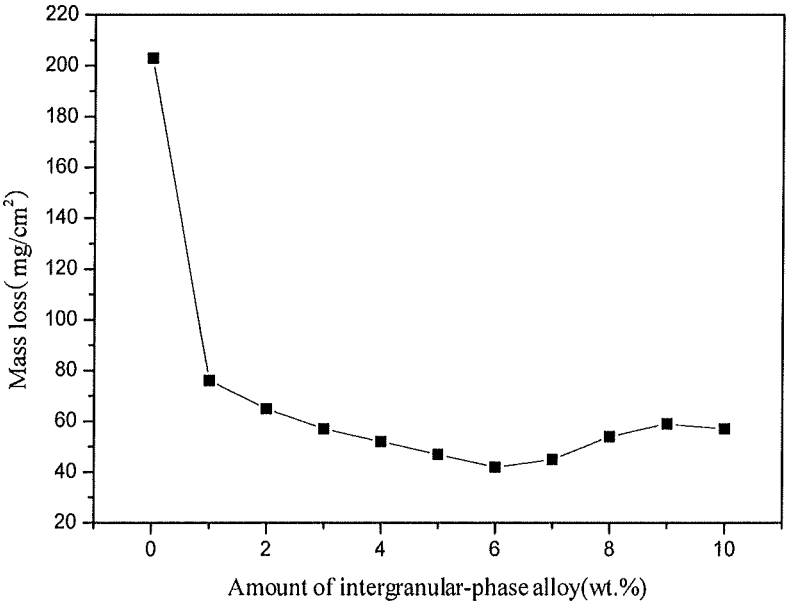
FIG. 7 is a graph showing the mass loss of magnets as function of intergranular-phase alloy additives. The composition of the intergranular-phase is, by atomic percent, $Cu_{24}Mn_{10}Al_{60}Bi_6$. In contrast to the magnet without intergranular-phase alloy additives, magnet with additives shows decreased mass loss in evidence. The mass loss reduces with the increase of additives at the amount of 1~6 wt %.

Corrosion tests of the magnets were conducted in CORCELL High Pressure Kettle with size of Φ1×0.5 cm at 5~10 psig, 110~115° C. for 100 h. The mass loss of magnets as function of intergranular-phase alloy additives as shown in the FIG. 7.

Those skilled in the art will recognize, or be able to ascertain that the basic construction in this invention can be altered to provide other embodiments which utilize the process of this invention. Therefore, it will be appreciated that the scope of this invention is to be defined by the claims appended hereto rather than the specific embodiments which have been presented hereinbefore by way of example.

We claim that:

1. A sintered Nd—Fe—B permanent magnet obtained from a composition, comprising:

(a) 90-99% by weight of master-phase alloy; and (b) 1-10% by weight of intergranular-phase alloy, wherein the intergranular-phase alloy is an alloy having an electrostatic potential equal to or higher than that of the master-phase alloy and a melting point lower than that of the master-phase alloy, and the intergranular-phase alloy consisting essentially of:

(b1) 2-5% by atomic percentage of R, (b2) 20-40% by atomic percentage of N, and (b3) the balance M, wherein the R is at least one element selected from the group consisting of Nd, Dy, Tb, and Pr; the N is at least one element selected from the group consisting of Ni, Cu, Mn, Nb, and Ti; and the M in the intergranular-phase alloy is at least one element selected from the group consisting of Mg, Zn, and Sn, wherein the master-phase alloy is an alloy consisting essentially of:

(a1) 12-16% by atomic percentage of Nd, (a2) 5.4-6.6% by atomic percentage of B, (a3) 0.01-6% by atomic percentage of M, and (a4) the balance Fe, wherein the M in the master-phase alloy is at least one element selected from the group consisting of Pr, Dy, Tb, Nb, Co, Ga, Zr, Al, Cu, and Si, wherein the sintered Nd—Fe—B permanent magnet is obtained by a two alloy method comprising: mixing powder of the master-phase alloy and powder of the intergranular-phase alloy to form a powder mixture; compacting the powder mixture to form a powder compact; and sintering the powder compact at a temperature greater than the melting point of the intergranular-phase alloy;

and wherein the sintered Nd—Fe—B permanent magnet has a mass loss of 28-100 mg/cm$^2$, wherein the mass loss is measured by placing the sintered Nd—Fe—B permanent having a size of Φ1 cm×0.5 cm (Φ is diameter) in COR-CELL High Pressure Kettle at a temperature of 110-115° C. under a pressure of 5-10 psig for 100 h.

2. The sintered Nd—Fe—B permanent magnet of claim 1, wherein the sintered Nd—Fe—B permanent magnet is produced by the two-alloy method comprising the steps of:

(1) preparing the powder of the master-phase alloy having an average particle size of 3~8 μm;

(2) preparing the powder of the intergranular-phase having an average particle size of 1~4 μm;

(3) mixing the powder of the master-phase alloy obtained in step (1) and the powder of the intergranular-phase alloy obtained in step (2) to form the powder mixture;

(4) compacting the powder mixture of step (3) in a magnetic field of 1.2-2.0T to form the powder compact, and sintering the powder compact at a temperature of 1050-1125° C. in a non-oxidizing or vacuum atmosphere of $10^{-3}$~$10^{-4}$ Pa to form a sintered body;

(5) heating the sintered body of step (4) at a temperature of 920~1020° C. for 2-4 hours, followed by cooling at a cooling rate of 1~4° C./min to room temperature;

(6) heating the sintered body obtained in step (5) at a temperature of 500~650° C. for 2-4 hours followed by cooling at a cooling rate of 100~400° C./min.

3. The sintered Nd—Fe—B permanent magnet of claim 1, wherein the sintered Nd—Fe—B permanent magnet includes $Nd_2Fe_{14}B$ main phase grains having an average size of about 7 microns.

4. The sintered Nd—Fe—B permanent magnet of claim 1, wherein the sintered Nd—Fe—B permanent magnet comprises 4~8% by weight of the intergranular-phase alloy.

5. The sintered Nd—Fe—B permanent magnet of claim 1, wherein the N is at least one element selected from the group consisting of Ni, Mn, and Ti.

6. The sintered Nd—Fe—B permanent magnet of claim 1, wherein the N is Ti and Ni and Nb, or Cu and Mn.

* * * * *